United States Patent [19]

Neuser et al.

[11] 4,151,385

[45] Apr. 24, 1979

[54] TURNING GRIP DRIVE FOR ROCKER-ARM ACTUATED POWER SWITCH

[75] Inventors: Johannes Neuser, Netphen; Helmut Menzel, Kreuztal-Ferndorf, both of Fed. Rep. of Germany

[73] Assignee: Hundt and Weber, Schaltgerate GmbH, Freudenberg, Fed. Rep. of Germany

[21] Appl. No.: 895,821

[22] Filed: Apr. 13, 1978

[30] Foreign Application Priority Data

Apr. 19, 1977 [DE] Fed. Rep. of Germany ..... 2717113

[51] Int. Cl.[2] ..... H01H 3/04; H01H 3/20

[52] U.S. Cl. ..... 200/153 LA; 200/331; 200/337

[58] Field of Search ..... 200/331, 332, 335, 336, 200/337, 50 A, 153 L, 153 LA

[56] References Cited

U.S. PATENT DOCUMENTS

| | | | |
|---|---|---|---|
| Re. 22,559 | 10/1944 | Rowe | 200/337 |
| 2,127,869 | 8/1938 | Junghans | 200/68 |
| 2,752,464 | 6/1956 | Seeger | 200/337 |
| 2,961,501 | 11/1960 | Piteo | 200/50 A |
| 3,171,908 | 3/1965 | Malota | 200/50 A |

FOREIGN PATENT DOCUMENTS

| | | | |
|---|---|---|---|
| 224757 | 11/1958 | Australia | 200/331 |
| 676726 | 12/1963 | Canada | 200/331 |

*Primary Examiner*—Steven L. Stephan
*Attorney, Agent, or Firm*—W. A. Elchik

[57] ABSTRACT

An improved switch operating mechanism comprises a rotary type lever for operating a toggle switch lever or slide switch lever with improved means for coupling the levers.

8 Claims, 6 Drawing Figures

FIG. 1
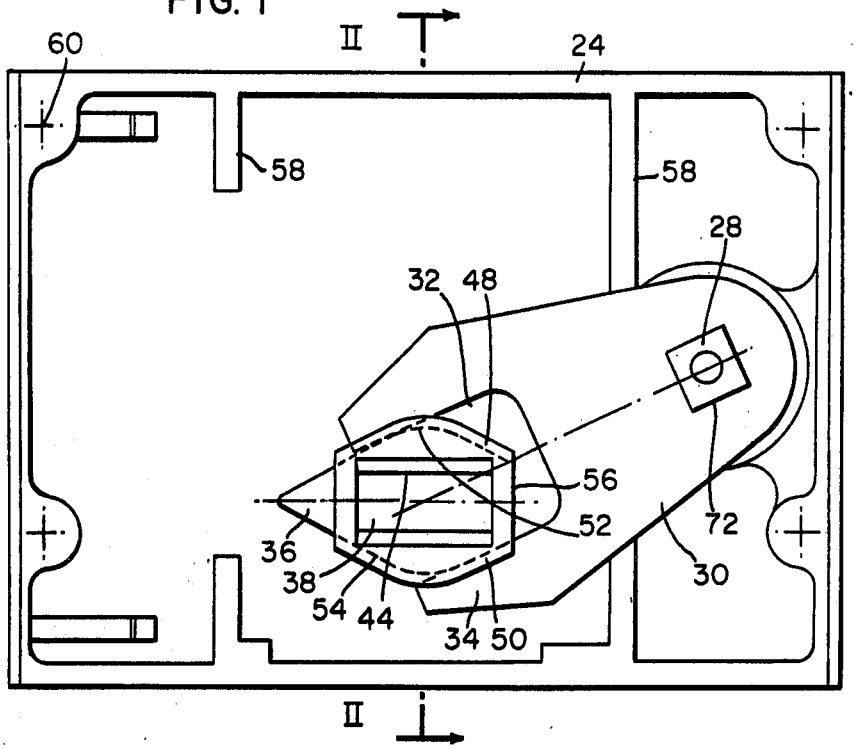
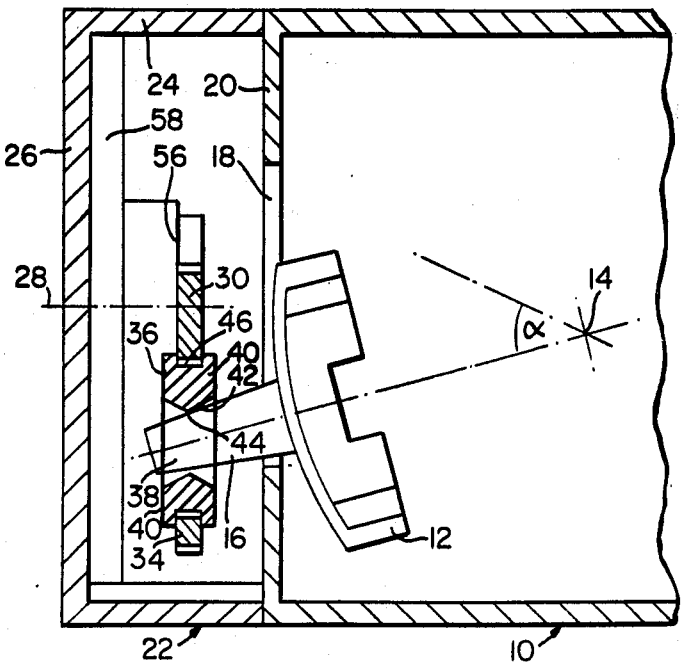
FIG. 2

TURNING GRIP DRIVE FOR ROCKER-ARM ACTUATED POWER SWITCH

CROSS-REFERENCE TO RELATED APPLICATION

Priority rights of the German patent application P 2,717,113.7, filed Apr. 19, 1977, upon which this application is based, are claimed.

Parts of the mechanism disclosed herein are disclosed in the copending application Ser. No. 895,830, filed concurrently herewith.

BACKGROUND OF THE INVENTION

The invention concerns an actuating mechanism for a toggle switch or a slider switch in which the rocking or sliding motion of the switching lever of a power switch is converted by means of a mounted shift lever device into a rotational motion over part of a circle.

Mechanisms for power switches, which are provided originally with a toggle switch or also with a slider switch, are already known. These mechanisms are employed to convert the rocking or sliding motion of these switches into a rotary motion, the arrangement being such that the axis of this rotary motion lies essentially perpendicular to the direction of translation or to the rocking axis of the said power switch. A conversion of this type in the motion is frequently required because many of the specifications put out, for example, by the power supply companies, must be observed and according to which the power switches must be fitted with rotary drives for reasons of greater safety and easier switchability. In order to render already existing toggle or slider switches usable at places where rotary devices of this type are specified, auxiliary devices are required for the power switches, the said devices effecting the necessary matching.

A drawback associated with previously known actuating mechanisms for such power switches resided in the fact that their construction was relatively complicated and was thus expensive and liable to damage. In addition, the friction in the known rotary devices is relatively high so that the forces required to actuate the switch are also relatively high, and thus, with large power switches especially, switching by hand is either no longer possible or requires great effort.

SUMMARY OF THE INVENTION

The objective of the invention is to improve an actuating mechanism of the above-mentioned type in such a way that it serves to convert the rocking or sliding motion into a rotary motion using as few components as possible so that the construction is simplified as a result of which not only is it cheaper to produce such a mechanism but also the liability to become damaged is reduced. In addition, the actuating mechanism should reduce, as much as possible, the friction in the motion-converting device.

The objective is attained in accordance with the invention by a plate-shaped coupling member which is provided with an opening which matches the shape of the power-switch's rocking or slider lever, the size of the said opening increasing outward from a plane lying within the said plate and toward the outer surfaces of the plate, the said plate having on its outer periphery a groove whose base takes the form of a curve and in contact with which slides the inner edges of a plate-shaped fork-like lever, the setup also being characterized by the provision of a housing which can be mounted on the power switch and which is provided with a bearing for a shaft which transmits the rotary motion and whose end lying within the said housing is rigidly attached to the fork-like lever with which it rotates.

Thanks to this special form of construction, the rocking or sliding motion is converted into a rotational motion with the use of only two parts, thereby making possible an exceptionally large simplification of the actuating mechanism. In addition, these two parts are so constructed that only one point of contact exists between the force-transmitting parts, so that the friction also becomes very small.

An especially favorable conversion of the motion can be effected by arranging that the curved surface at the base of the groove consists of two conic sections, the concave sides of whose vertices are opposite to each other and whose inter-vertex distance is essentially equal to the distance between the opposite inner faces of the fork-like member, while the radius of curvature in the vertex is approximately equal to half the distance between the said vertices.

The simplest form for the curved surfaces is one in which the surfaces at the base of the groove form a — common — circle (see Claim 4).

In order to reduce the pressure per unit area between the fork-like member and the coupling member, it is, however, more satisfactory when the radius of curvature decreases as the distance from the vertex increases (see Claim 3).

In the main, the power switch's switching-lever is rectangular, the arrangement being such that the longer sides of the rectangle lie perpendicular to the direction of motion. In this case, an especially favorable form of construction in accordance with the invention is one in which the opening is rectangular and the increase in the aperture occurs on the longer sides of the rectangle on approaching the two outer surfaces of the plate.

The friction becomes particularly low when the increase in the aperture is linear and takes place at an angle with respect to the outer surfaces, the said angle being greater than the half maximum rocking angle of the rocking lever (toggle) in the case of a power switch provided with a toggle switch.

Usually, power switches are made in such a way that it is especially advantageous to arrange for the mechanism's housing to be screwed on to the toggle switch and for its dimensions to be such that it fits snugly against the toggle switch. By this form of construction, the power switch and the mounted housing for the actuating mechanism together form a structural unit.

With the actuating mechanism made in accordance with the invention, it is immediately possible to provide the switching lever connected to the end of the shaft located outside the housing with a locking device which makes it possible to lock the said switching lever in one or more positions with respect to the housing. For reasons of safety, one of these locking possibilities can be necessary or even specified.

BRIEF DESCRIPTION OF THE DRAWINGS

FIG. 1 shows a view from below of the actuating-mechanism's housing with the shifting (or rotating) mechanism which consists of two parts, FIG. 2 presents a section taken through FIG. 1 along the line II—II indicated by the arrows.

DESCRIPTION OF THE INVENTION

Figure 4:
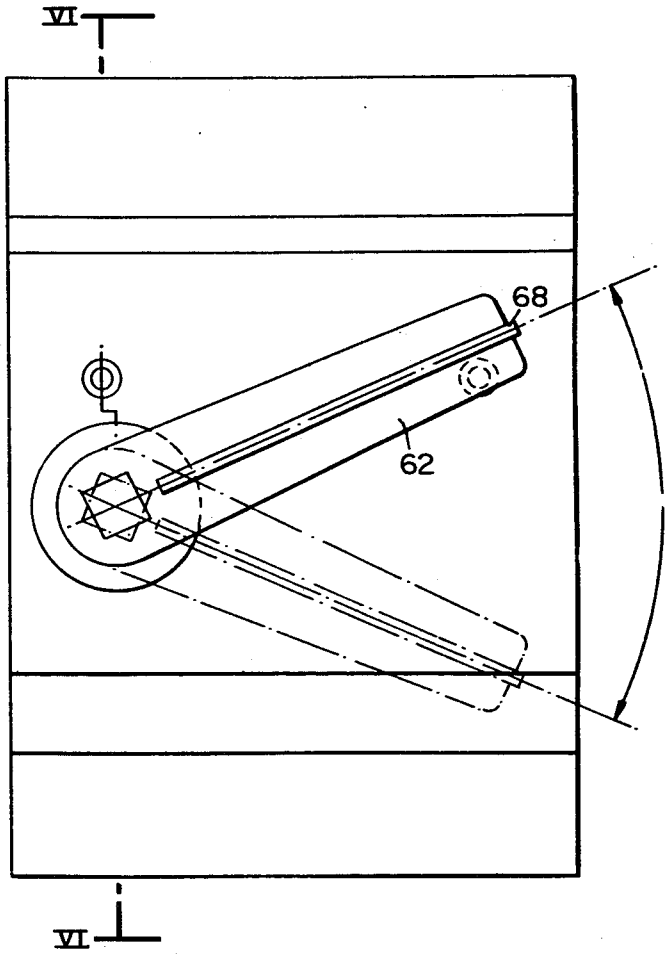
FIG. 4 shows a view of the housing as seen from above of the form of construction shown in FIG. 3 and showing the actuating lever.

The basic principles of the invention can be seen from FIGS. 1 and 2.

The power switch which is denoted by 10 is provided with a rocker arm 12 which can be rocked around a rotation axis 14 inside the power switch through an angle $\alpha$, such a rocking action producing the switching operation. The switching lever 16 passes through a slot 18 located in the front bulkhead 20 in the housing of power switch 10.

In order to convert the translating motion carried out by the said switching lever 16 into an easily executed rotary movement, use is made of the actuating mechanism 22 made in accordance with the invention, the said mechanism consisting of a housing 24 which fits snugly on to the bulkhead 20 of power switch 10, a bearing (not shown) being provided in the front wall 26 of housing 24 for receiving a shaft 28. Mounted on the end of said shaft 28 within housing 24 is a plate-shaped lever 30 whose free end terminates in a mouth 32 whereby a two-pronged fork 34 is formed.

The second important part of the rotary device is formed by a coupling member 36 which is here provided with a rectangular aperture 38 whose short sides are cut straight while, in the region of the longer sides, the aperture widens out in the direction of the outer surfaces 40 of said coupling member 36, as can clearly be seen from FIG. 2. In the cross-sectional view shown in FIG. 2, this widening-out is produced by the sloping faces 42 so that a knife-edge 44 is produced within the aperture 38 along the two long interior edges.

The angle of inclination made by sloping faces 42 with respect to exterior faces 40 is such that, even when the rocker arm 12 is in its extreme positions, switching lever 16 touches coupling member 36 only in the region of knife edges 44. Essentially, this means that the angle of inclination of sloping faces 42 with respect to exterior faces 40 must be somewhat greater than half angle $\alpha$.

Instead of allowing the faces 42 to run straight to form a knife edge 44, the cross-section of the aperture could also be rounded. This would, of course, increase the friction somewhat. On the other hand, the surface pressure (compression) would be reduced, so that the material requirements would be reduced.

It is obvious that, with switching levers 16 with a different cross-section, aperture 38 must be matched accordingly.

Located in the outer periphery of coupling member 36 is a groove 46 whose width is approximately equal to the thickness of forked-lever 30, so that the fork's prongs 34 can be guided in groove 46. To each prong there belongs a section of groove 46. The two groove-sections have bottom surfaces which follow a certain curve, as indicated by the broken lines in FIG. 1. It is especially advantageous to choose the vertex regions of conic sections for these curves, namely the vertex regions of ellipses, hyperbolas or parabolas. The curved sides of the two groove-sections, respectively denoted by 48 and 50, consist, for example, of hyperbolas whose vertices face away from each other, the region of greatest curvature, or smallest radius of curvature, being located in the vertex region 52. The radius of curvature increases outside said vertex 52.

When lever 30 is tilted, the prongs 34 of the fork-lever move in the groove sections 48 and 50, i.e. the interior surfaces of mouth 32 of lever 30 move on the bottom surfaces of the groove-sections which follow curves 54. The special shape of the curve, as illustrated in FIG. 1, ensures that, when lever 30 is in its extreme positions, in which particularly high forces are to be borne, the surface pressure (compression) becomes smaller, on account of the smaller curvature, than in the central region where the forces to be transmitted are, for the most part, appreciably smaller. In the event that the forces to be transmitted in all positions of lever 30 are approximately the same, the conic section chosen can be an ellipse which has degenerated into a circle, that is, the two groove-sections 48 and 50 form a common circle.

In order not to increase unnecessarily the depth of mouth 32 and hence the rigidity of fork 34, it can be advantageous to cut-off the coupling member 36 at the end lying within the mouth, as shown at 56.

Housing 24, in which is located the actuating mechanism made in accordance with the invention, can be so constructed that lever 30 is additionally guided by a suitable supporting surface 56.

In addition, the housing can be provided with stiffening ribs 58 and with holes 60 in order to screw housing 24 on to housing 10 of the power switch.

Figure 3:
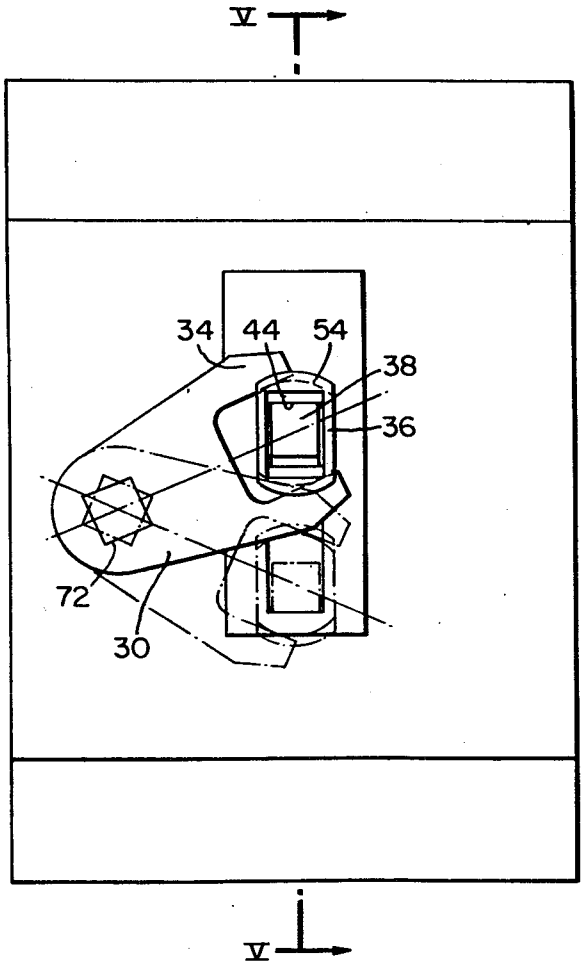
FIG. 3 presents a view from below of a form of construction made in accordance with the invention and with dimensions which are somewhat different from those indicated in FIG. 1.

FIG. 3 illustrates a somewhat modified form of construction in which curves 54, which are formed by the sections of groove located within coupling member 36, are circular in shape. In this case, knife edges 44 are formed on the two narrow sides of the rectangular aperture 38. The most important difference between the form of construction shown in FIG. 1 and the form of construction shown in FIG. 3 lies in the fact that, in the case of the construction shown in FIG. 1, the direction of motion of the switching lever is parallel to the narrow side of the power switch whereas, with the form of construction illustrated in FIG. 3, the direction of motion is parallel to the longer side of the said power switch.

Figure 6:
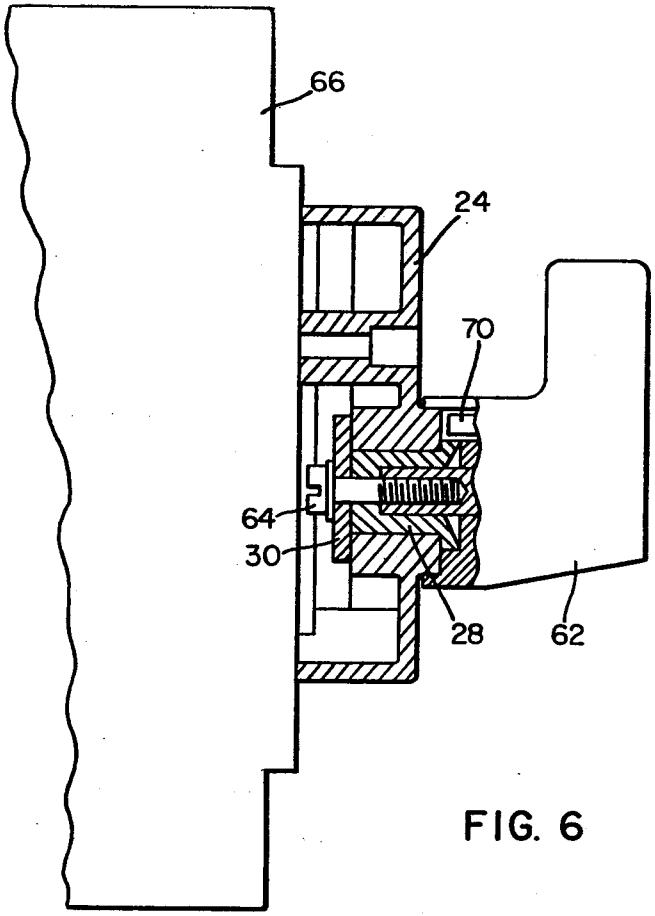
FIG. 6 shows a partial section through the mechanism illustrated in FIG. 4, taken along the line VI—VI indicated by the arrows.
Figure 5:
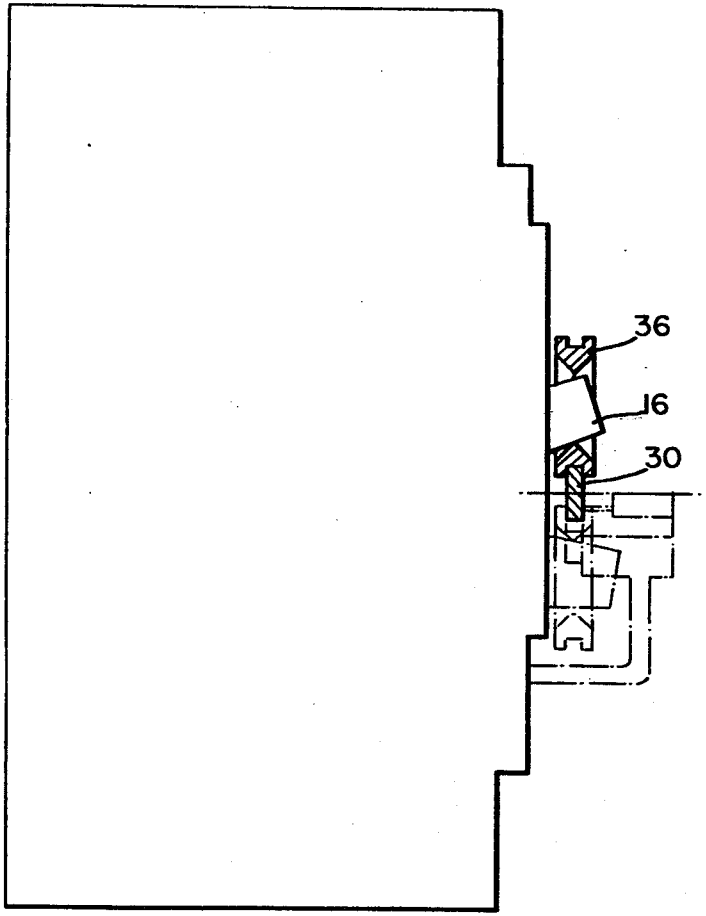
FIG. 5 shows a partial view through the mechanism shown in FIG. 3, taken along the line V—V indicated by the arrows.

FIG. 5 presents a cross-sectional view similar to that shown in FIG. 2, while FIGS. 4 and 6 show how the hand (lever) switch used to actuate the mechanism made in accordance with the invention can be constructed. As shown in FIG. 4, the hand (or lever) switch consists of a handle 62 which is rigidly fixed to the end of the rotatable shaft lying outside the mechanism's housing 24, the handle being fixed, for example, by means of a screw 64 which also simultaneously holds lever 30 on shaft 28.

As may be seen from FIG. 6, with this form of construction, housing 24 is smaller than housing 66 of the power switch on which is mounted the actuating mechanism made in accordance with the invention. Consequently, this form of construction is especially suitable for very large power switches.

Provided in handle 62 can be an auxiliary lever 68 which is rotatably mounted within the handle in the vicinity of the point of rotation of said handle 62, and which projects out in a spring-loaded pin 70 which, on pressing the auxiliary lever 68 into suitable recesses, not shown, engages in housing 24 and thereby fixes the position of lever 62. Several locking positions of this type can be created by providing several recesses.

By means of the above construction, a mechanism can be created for a toggle switch or for a slider switch, the said mechanism consisting essentially of two parts whereby the rocking movement can be converted into a rotational movement. By giving the contact surfaces a special form, the force-transmitting parts can be made to have only one point or knife-edge contact and thus experience very little friction.

The force is transmitted to lever 30 from handle 62 as, for example, via a square bar 72. By a movement of lever 30, coupling member 36 is guided by said lever 30 in the switching direction. Forked member 34 of lever 30 rolls over the radii of the coupling member. Deviation in a direction at right angles is not possible because, on account of its grooves, coupling member 38 is supported (guided) by lever 30. As a result of the rolling motion, the rocking movement of lever 30 is evened-out not only with regard to the change in angle but also with regard to the translatory motion.

We claim:

1. A mechanism for actuating a toggle switch or a slide switch whereby the rocking or sliding motion of the switching lever of a power switch is converted, via a shift lever device, into a rotational motion which occupies part of a circle, the said mechanism being characterized by the provision of a plate-shaped coupling member (36) with an aperture (38) which is matched to the shape of the lever (16) of the power switch (10), the size of the said aperture increasing from a plane lying within the said plate (36) on approaching the outer faces (40) of the said plate (36), the mechanism being provided with a groove (46) located in the peripheral edge of the plate (36), the basal surface of the said groove being curved and being abutted against by the internal edges of a plate-shaped lever fork (34) which slide in the said groove (46), the mechanism also being characterized by the provision of a housing (24) which can be mounted on the power switch (10) and which is provided with a bearing for a shaft (28) which transmits the rotary motion and which is rotatably and firmly fixed by the end stationed within the housing (24) to the said lever-fork (34).

2. An actuating mechanism in accordance with claim 1 and which is so characterized that the curved basal surface of the groove (46) consists of two crested regions (48, 50) whose concave sides (54), which take the form of conic sections, face each other, the distance between the vertices being essentially equal to the distance between the facing interior surfaces of the fork (34) while the radius of curvature of the vertex (52) is approximately equal to half the distance between the said vertices.

3. An actuating mechanism in accordance with claim 2 and which is so characterized that the radius of curvature decreases with increasing distance from the vertex (52).

4. An actuating mechanism in accordance with claim 2 and which is so characterized that the basal surfaces (48, 50) of the groove (46) form a circle.

5. An actuating mechanism in accordance with claim 1 and which is so characterized that the opening (32) is rectangular and that the enlargement in the opening is provided on the longer sides of the rectangle, and increases toward the two outside surfaces (40) of the plate (36).

6. An actuating mechanism in accordance with claim 5 and which is so characterized that the increase in the aperture (42) is linear and at an angle with respect to the outside surface (30), the angle being larger than the half maximum rocking angle of the toggle-lever (12).

7. An actuating mechanism in accordance with claim 1 and which is so characterized that the housing (24) can be screwed on to the power switch (10) and closes it off snugly.

8. An actuating mechanism in accordance with claim 1 and which is so characterized that the end of the shaft (28) lying outside the housing (24) is connected to a switching lever (62) whose setting can be locked with respect to the housing (24) at one or more places (68, 70).

* * * * *